United States Patent [19]

Shimizu et al.

[11] Patent Number: 5,074,685

[45] Date of Patent: Dec. 24, 1991

[54] HEAD GAP ADJUSTMENT DEVICE

[75] Inventors: Makoto Shimizu; Hiroshi Konishi, both of Tokyo, Japan

[73] Assignee: Oki Electric Industry Co., Ltd., Tokyo, Japan

[21] Appl. No.: 675,037

[22] Filed: Mar. 26, 1991

Related U.S. Application Data

[63] Continuation of Ser. No. 475,937, Feb. 6, 1990, abandoned.

[30] Foreign Application Priority Data

Feb. 10, 1989 [JP] Japan ..... 1-29638
Jun. 1, 1989 [JP] Japan ..... 1-137535

[51] Int. Cl.[5] ..... B41J 11/20
[52] U.S. Cl. ..... 400/56; 400/120
[58] Field of Search ..... 400/120, 124, 55, 56, 400/58, 59

[56] References Cited

U.S. PATENT DOCUMENTS

| | | | |
|---|---|---|---|
| 4,010,834 | 3/1977 | Linder | 400/56 |
| 4,088,215 | 5/1978 | Bader | 400/56 |
| 4,172,671 | 10/1979 | Stewudd | 400/59 |
| 4,174,908 | 11/1979 | Wehler | 400/56 |
| 4,420,269 | 12/1983 | Acuermann et al. | 400/59 |
| 4,652,153 | 3/1987 | Kotsuzumi et al. | 400/56 |
| 4,676,675 | 6/1987 | Suzuki et al. | 400/56 |
| 4,881,835 | 11/1989 | Niikawa | 400/56 |
| 4,917,512 | 4/1990 | Mimura et al. | 400/56 |
| 4,927,277 | 5/1990 | Niikawa | 400/56 |

FOREIGN PATENT DOCUMENTS

| | | | |
|---|---|---|---|
| 2824621 | 12/1979 | Fed. Rep. of Germany | 400/56 |
| 2267885 | 11/1975 | France | 400/56 |
| 0054583 | 3/1984 | Japan | 400/56 |
| 0124872 | 7/1984 | Japan | 400/56 |
| 0083856 | 5/1985 | Japan | 400/56 |
| 0137765 | 6/1986 | Japan | 400/120 |
| 0119077 | 4/1987 | Japan | 400/58 |
| 2077194 | 12/1981 | United Kingdom | 400/56 |

OTHER PUBLICATIONS

"Electronic/Manual Forms Thounets Control Mechanism for a Wire Matrix Print Head Printer" IBM Tech. Discl. Bul. vol. 32, No. 1 6/89, 355-356.

"Capacitive Head Gap Measurement for Printers" IBM Tech. Discl. Bull, vol. 29, No. 3 Aug. 1986, pp. 1412-1413.

"Magnetically Attracted Flexable Plates" IBM Tech. Discl. Bull., vol. 28, No. 9, 286 pp. 4100-4101.

*Primary Examiner*—Eugene H. Eickholt
*Attorney, Agent, or Firm*—Spencer & Frank

[57] ABSTRACT

An automatic head gap adjustment device for a printer has a plunger that protrudes beyond the print head toward the platen, a linear transducer that detects the amount by which the plunger is depressed, and a motor for widening and narrowing the head gap by moving the print head or platen. A controller drives the motor forward, narrowing the head gap, until the signal output by the transducer changes by a certain amount, then drives the motor in reverse for a fixed amount, widening the head gap, then preferably drives the motor forward again by a smaller fixed amount to take up play in the drive mechanism. This device adjusts the head gap accurately despite changes in ambient conditions.

28 Claims, 10 Drawing Sheets

HEAD GAP ADJUSTMENT DEVICE

This application is a continuation application of Ser. No. 07/475,937, filed Feb. 6th, 1990 and now abandoned.

BACKGROUND OF THE INVENTION

This invention relates to a head gap adjustment device for automatically adjusting the head gap of a printer.

A printer comprises a platen that supports a print medium, such as a sheet of paper, multi-ply forms or a bankbook, and a print head, disposed facing the platen, for printing characters and symbols on the print medium. The head gap refers to the gap between the print head and the print medium. For best printing, the head gap must be adjusted to a certain optimal size.

The print head of a dot matrix impact printer, for example, has a set of dot wires which are driven forward to press a ribbon against the print medium, thereby printing patterns of dots. For maximum printing speed the gap must be as small as possible to let the dot wires impact the ribbon and print medium as quickly as possible.

To obtain the optimum head gap the position of the print head must be adjusted according to the thickness of the print medium, which may range from about 0.05 mm for a single sheet of paper, to as much as 1.5 mm for multi-ply forms or a bankbook. The adjustment should preferably be automatic, since manual adjustment is inconvenient and difficult to perform accurately.

A prior-art device for automatic head gap adjustment comprises a pulse-driven stepping motor capable of moving the print head forward or backward in relation to the platen. Starting from a fixed position, the print head is driven forward for a fixed number of pulses, then backward for a smaller fixed number of pulses. The forward pulse sequence drives the print head into contact with the print medium, at which point forward motion stops. The forward pulse sequence continues thereafter until the fixed number of pulses is reached, the print head and stepping motor remaining substantially stationary. The reverse pulse sequence then retracts the print head from the print medium by a fixed distance, adjusting the head gap to the proper size.

A problem with this device is that the continued sending of drive pulses to the stepping motor after the print head is stopped by contact with the print medium tends to make the stepping motor oscillate, creating a strong, unstable force that pushes the print head further forward, deforming the print medium and/or platen. The amount of deformation is variable because the oscillation is unstable, and because the number of pulses sent after contact differs depending on the thickness of the print medium. At the end of the forward pulse sequence, the print head is thus disposed an unpredictable distance forward of the original point of contact. The position to which the reverse pulse sequence moves the print head is unpredictable by the same amount. Applying fixed sequences of forward and reverse drive pulses to the stepping motor therefore fails to adjust the head gap with satisfactory accuracy.

Another problem is that driving the print head against the print medium may smudge the print medium.

SUMMARY OF THE INVENTION

An object of the present invention is accordingly to adjust the head gap of a printer accurately as well as automatically.

Another object is to adjust the head gap accurately regardless of ambient conditions.

A further object is to adjust the head gap without smudging the print medium.

In accordance with the invention, a head gap adjustment device for adjusting the gap between the print head of a printer and a print medium disposed on a platen of the printer has a motor, drivable in forward and reverse directions, for narrowing the gap when driven forward and widening the gap when driven in reverse. The motor may alter the gap by moving either the print head or the platen. A linear transducer is fixedly attached to the print head. A plunger is slidable relative to the transducer, with the tip of the plunger projecting beyond the print head toward the platen. The linear transducer produces an output signal representative of the relative position of the tip of the plunge. A controller connected to the motor and the linear transducer drives the motor forward until the output signal changes by a certain amount, then drives the motor by a fixed amount in reverse. The controller preferably concludes the adjustment by driving the motor in reverse by an extra fixed amount, then driving the motor forward again by the same extra fixed amount.

DETAILED DESCRIPTION OF THE INVENTION

A novel head gap adjustment device for adjusting the gap between a print head of a printer and a print medium such as a sheet of paper, multi-ply forms or a bankbook, disposed on a platen of the printer will be described with reference to the drawings. A general description will first be given with reference to FIGS. 1 to 4. Next a detailed description of an application to a printer with a cylindrical platen will be given with reference to FIGS. 5 and 6. Then a detailed description of an application to a printer with a flat platen will be given with reference to FIGS. 7 and 8.

Figure 1:
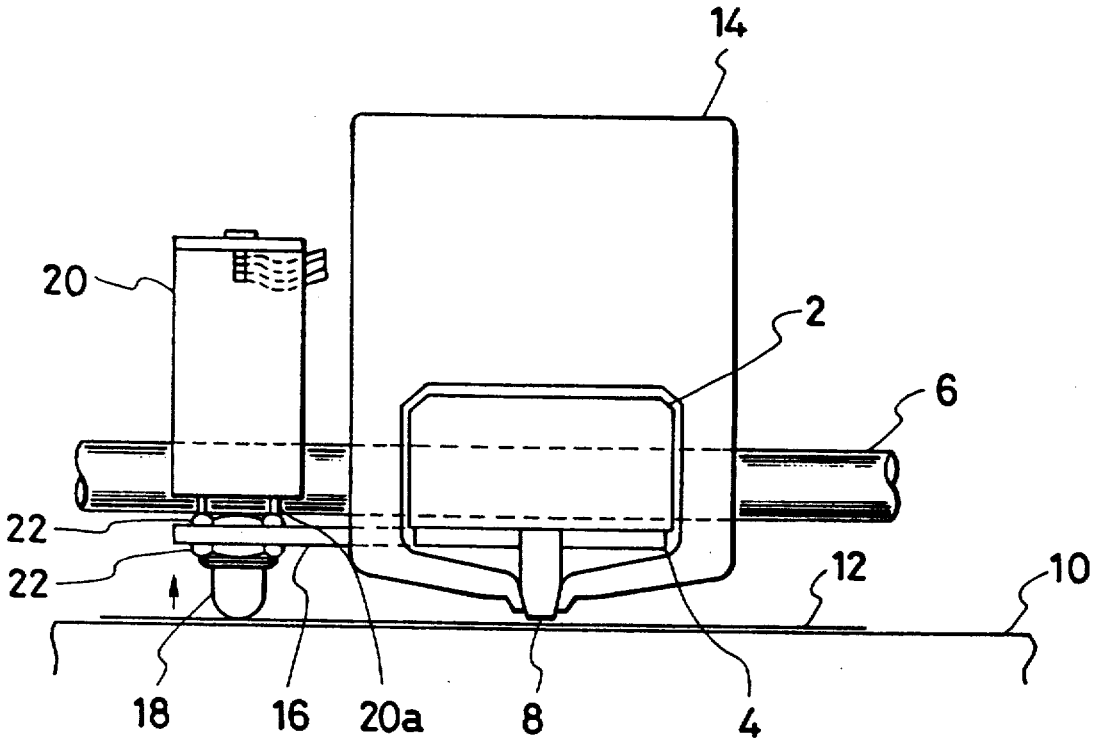
FIG. 1 is a partial view of a novel head gap adjustment device according to the invention, illustrating a print head, platen, plunger, and linear transducer.

FIG. 1 is a partial view of the novel head gap adjustment device and associated parts of the printer. A print head 2 is attached to a carriage 4 which is slidably mounted on a guide shaft 6, permitting motion in the left or right direction in the drawing to print characters in different positions. The guide shaft 6 both guides and supports the print head 2 in this motion. The front end 8 of the print head 2 extends toward a platen 10 that supports a print medium 12. The gap between the front end 8 of the print head 2 and the print medium 12 will be referred to as the head gap. A ribbon cartridge 14, also mounted on the carriage 4, holds a ribbon that passes through the head gap.

Figure 2:
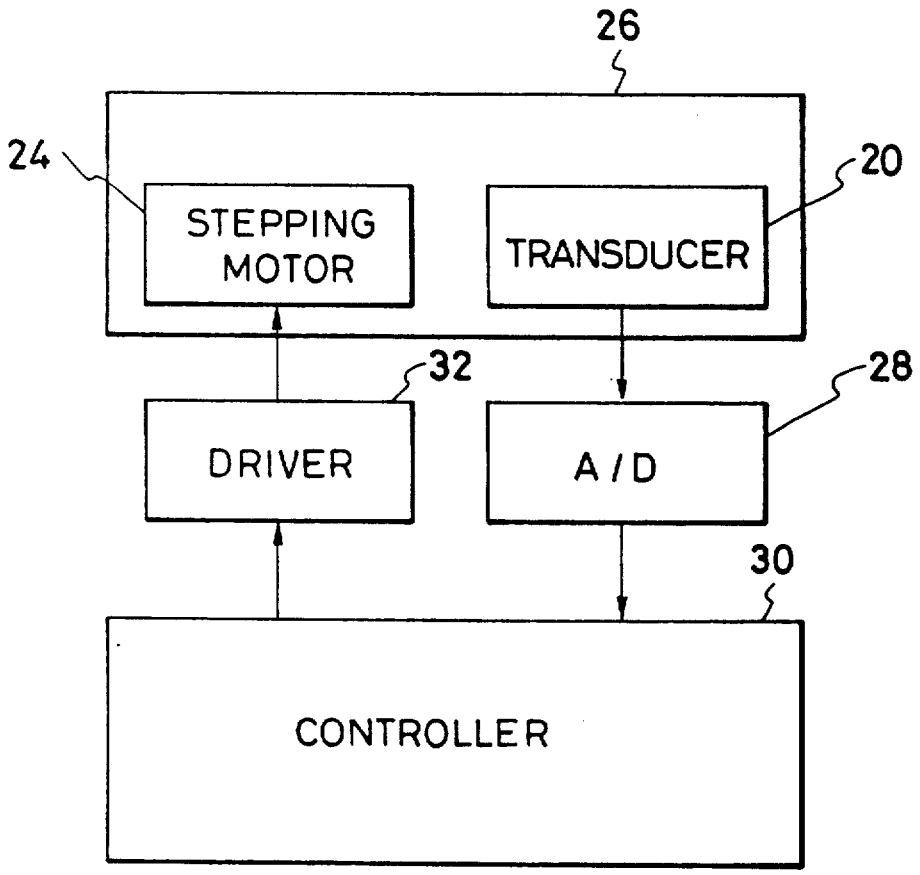
FIG. 2 is a block diagram of the head gap adjustment device, illustrating the control circuitry.

The head gap can be altered by means of a motor such as a stepping motor that will be shown in FIG. 2. The motor may alter the gap by moving either the print head, as will be illustrated in detail in FIGS. 5 and 6, or the platen, as will be illustrated in detail in FIGS. 7 and 8. The motor is drivable in both the forward and reverse directions: when driven forward the motor narrows the head gap; when driven in reverse it widens the head gap.

Extending from one side of the print head 2 is an arm 16 to which are attached a plunger 18 and a linear transducer 20. The linear transducer 20 is fixedly attached to the arm 16, hence to the print head 2. The plunger 18 is slidable in the vertical direction in FIG. 1, relative to the linear transducer 20. In the drawing, the plunger 18 slides vertically inside the linear transducer 20. The tip of the plunger 18 projects beyond the front end 8 of the print head 2 toward the platen 10. The drawing shows the plunger 18 being pushed upward by contact with the print medium 12. The tip of the plunger 18 should preferably be rounded for good contact with the print medium 12.

The linear transducer 20 converts the relative position of the plunger 18 to an output signal, which varies in a substantially linear manner as the plunger 18 moves with respect to the linear transducer 20 and the print head 2.

For example, the plunger 18 comprises a permanent magnet and the linear transducer 20 comprises a Hall element that generates a voltage output signal representative of the relative position of the permanent magnet. Specifically, the output voltage V has a linear relationship to the stroke S of the plunger, the voltage rising as the plunger is pushed in.

The linear transducer 20 is attached to the arm 16 by a pair of nuts 22 threaded with a bolt 20*a* forming part of the linear transducer 20. The nuts 22 can be turned to adjust the position of the linear transducer 20 and plunger 18 during the manufacturing process. The linear transducer 20 also houses a spring or similar device, not shown in the drawing, that cause the plunger 18 to project by the maximum amount toward the platen 10 when the plunger 18 is not constrained by contact with the platen 10 or print medium 12. The position at which the plunger 18 is at its maximum projection will be referred to as its rest position.

FIG. 2 is a block diagram illustrating the control circuitry of the novel head gap adjustment device. Shown next to the linear transducer 20 is a stepping motor 24 which narrows or widens the head gap as mentioned earlier. The linear transducer 20 and stepping motor 24 are parts of the mechanical apparatus 26 of the printer. The output signal V generated by the linear transducer 20 is sent to an A/D converter 28 which converts the output signal V to a digital value and provides the digital value of V to a controller 30 comprising, for example, a single-chip microcomputer. The controller 30 receives print data from a host device, not shown, controls operation of the entire printer, including operation for a standby sequence and operation for a head gap adjustment sequence. During the standby sequence and the gap adjustment sequence, the controller 30 sends forward and reverse commands to a drive circuit 32, which generates corresponding drive pulses to drive the stepping motor 24 in the forward and reverse directions. Details of the structure and programming of the controller 30 will be omitted as being obvious to one skilled in the art.

Next the operation of the novel head gap adjustment device will be described with reference to FIGS. 1 to 4.

When the printer's power is switched on, or when printing on a print medium is completed and the print medium is discharged, the controller 30 in FIG. 2 begins a standby sequence in which it sends a sequence of reverse commands to the drive circuit 32. The drive circuit 32 sends corresponding reverse pulses to the stepping motor 24. The number of reverse commands and reverse pulses is a fixed number which is set to be sufficient to widen the head gap to its maximum extent, regardless of the previous gap size (i.e., to be a little more than just enough even when the previous head gap is minimum), allowing sufficient space for ribbon cartridge replacement, or for the setting of print medium 12 without having the print medium 12 contact the plunger 18.

At this maximum head gap, the plunger 18 is fully projecting (with respect to the linear transducer 20) in its rest position, and the linear transducer produces a corresponding output signal $V_1$. The value of this output signal $V_1$ fluctuates due to fluctuation in the environmental temperature and the power supply voltage. The output signal of the transducer 20 is converted by the A/D converter 28 into a digital value, also denoted $V_1$, and is input to the controller 30.

When a print medium 12 is loaded for printing and print data are received from the host device such as a computer, the controller 30 begins a gap adjustment sequence in which the digital value $V_1$ is added to a certain fixed amount $V_0$ and the sum $V_2=V_1+V_0$ is stored in an internal register, not specifically shown, disposed within the controller 30. Then, the controller 30 begins sending forward commands to the drive circuit 32, causing the stepping motor 24 to turn in the forward direction, narrowing the head gap. This brings the tip of the plunger 18 into contact with the print medium 12, thus pushing the plunger 18 in as shown in FIG. 1 and raising the voltage V output by the linear transducer 20.

The controller 30 compares V with the value $V_2$ stored earlier, thereby testing the amount by which the output signal V changes with respect to its original value $V_1$. When V equals or exceeds $V_2$, the controller 30 stops sending forward commands and begins sending a fixed sequence of reverse commands, causing the drive circuit 32 to send a fixed number of reverse pulses to the stepping motor 24, which thus widens the head gap by a fixed amount.

Figure 3:
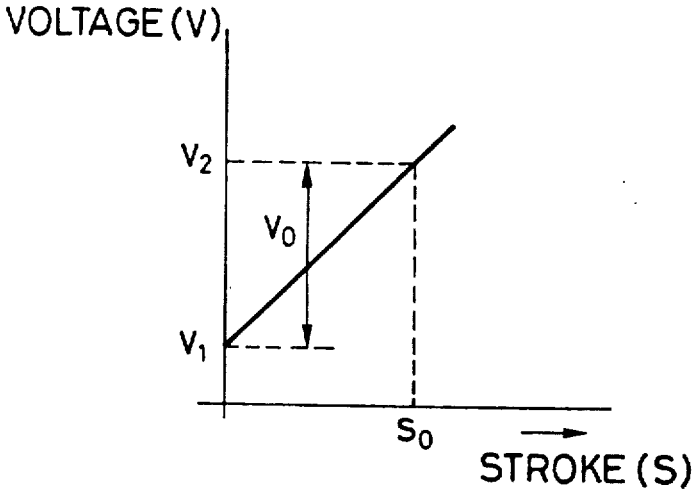
FIG. 3 is a diagram showing the relationship between the output voltage of the transducer and the position of the plunger relative to the linear transducer.
Figure 4A:
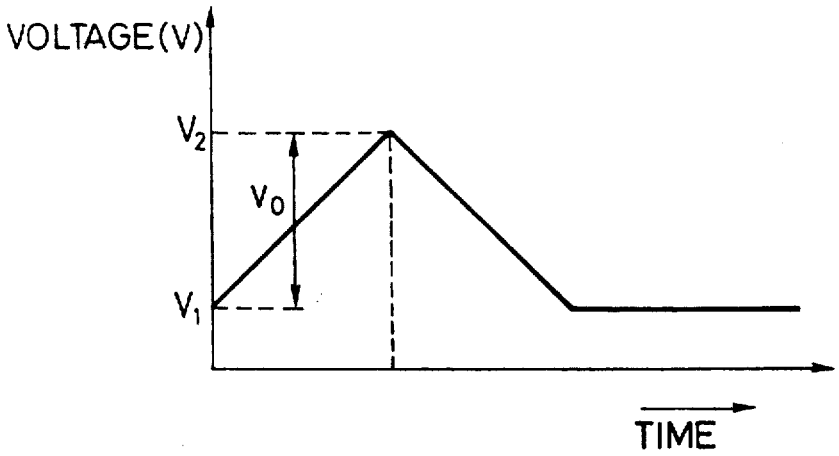
FIGS. 4A to 4C are timing diagrams illustrating the operation of the head gap adjustment device.
Figure 4B:
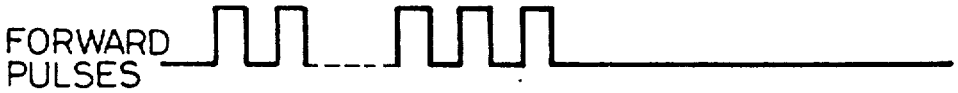
Figure 4C:
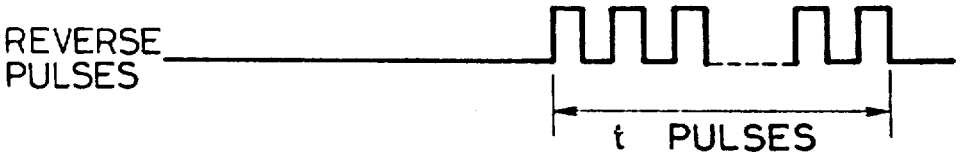
Figure 4D:
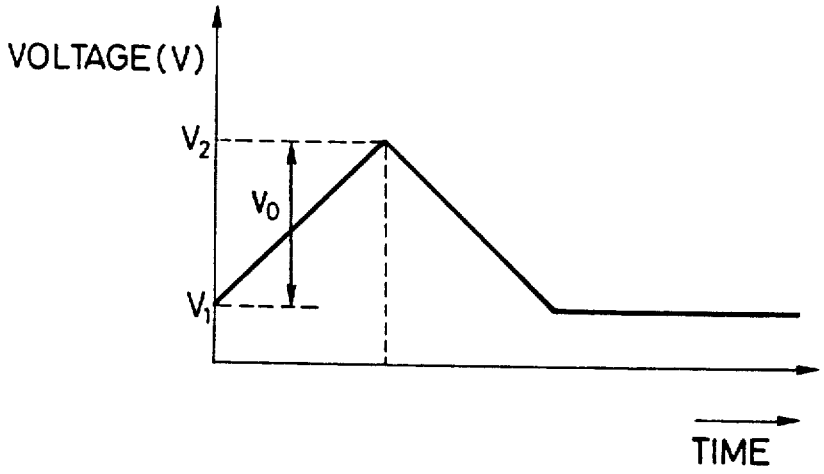
FIGS. 4D to 4F are further timing diagrams illustrating the operation of the head gap adjustment device.

FIG. 4A is a time chart showing the output signal V sent from the linear transducer 20 to the controller 30 via the A/D converter 28, and the drive pulses sent from the controller 30 to the stepping motor 24 via the drive circuit 32. Forward and reverse drive pulses are shown in FIGS. 4B and 4C, respectively. The relationship between the output voltage V and the stroke S of the stroke of the plunger 18 with respect to the linear transducer 20 is shown in FIG. 3.

The output signal V begins to rise when the plunger 18 contacts the print medium 12. When V reaches $V_2$, that is, when the stroke reaches $S_0$ and the change in V reaches $V_0$, a fixed number (t) of reverse pulses are sent, widening the gap by a fixed amount T. The number of reverse pulses should be so selected as to produce the desired head gap. The stroke $S_0$ should be so selected that $S_0<T$ to ensure that the tip of the plunger is separated from the print medium 12 when the head gap is at the desired value.

The head gap $G_1$ is automatically adjusted to $T-S_0$ (this being the final gap between the print medium 12 and the tip of the plunger 18) plus $G_2$ (the amount by which the plunger 18 projects in front of the print head 2). As a result, $$G_1=T-S_0+G_2.$$

The head gap $G_1$ is accordingly adjusted to the same value regardless of the thickness of the print medium 12.

The parameters T, $S_0$, and $G_2$ should be chosen so that $G_1$ is the optimal head gap for printing. In addition, $S_0$ must be smaller than $G_2$, so that voltage $V_2$ will be reached while the tip of the plunger 18 still projects beyond the print head 2, before the print head 2 presses the ribbon against the print medium 12. That is;

$$G_1>G_2>S_0$$

should be satisfied.

Figure 4E:
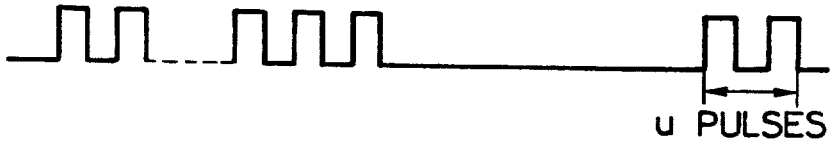
Figure 4F:
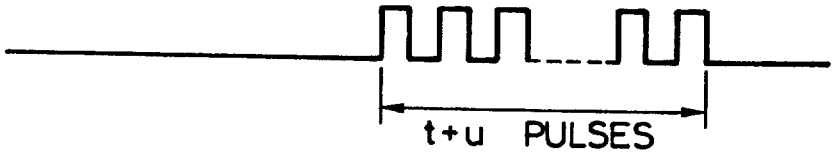

In a modification of the invention, the accuracy of the final head gap is improved by taking account of a play. That is, the stepping motor 24 and associated drive mechanism inevitably contains a certain amount of play P which absorbs the first few reverse pulses without changing the size of the head gap. Thus the final head gap $G_1$ will be $T-S_0+G_2-P$, and t pulses do not produce the expected change T in the head gap. To eliminate the effect of such play, as illustrated in FIGS. 4E and 4F, after sending t reverse commands to widen the head gap by the fixed amount T, the controller should preferably send a further fixed number (u) of reverse commands to widen the head gap by an extra fixed amount U, then send the same number (u) of forward commands to narrow the head gap again by the same extra fixed amount U. The number of extra pulses u should be at least sufficient to take up the play in the driving mechanism. Whatever play P is present in the forward-to-reverse switchover will then be canceled by an equal amount of play P in the reverse-to-forward switchover. The head gap will be accurately adjusted to:

$$G_1=T-S_0+G_2-P+U+P-U=T-S_0+G_2.$$

The reason for testing the change in the output signal V rather than its absolute value is that the output of magneto-electric transducers such as Hall elements fluctuates depending on the ambient temperature and the power supply voltage. By testing the change rather than the absolute value, the novel head gap adjustment device avoids the effects of such ambient conditions. As long as the relationship between V and S is linear and has a constant slope, the stroke $S_0$ corresponding to $V_0$ will remain constant.

Even if the slope of the relationship between S and V changes due to environmental effects, the effect of such changes can be minimized by setting $V_0$ to a small value, so that $S_0$ is on the order of 0.1 mm. A 10% slope variation, for example, will then cause a deviation of only 0.01 mm in the head gap.

Next a more detailed description of the invention will be given, showing an application to a printer with a cylindrical platen. In this application the stepping motor 24 moves the print head 2 by means of a cam mechanism.

Figure 5:
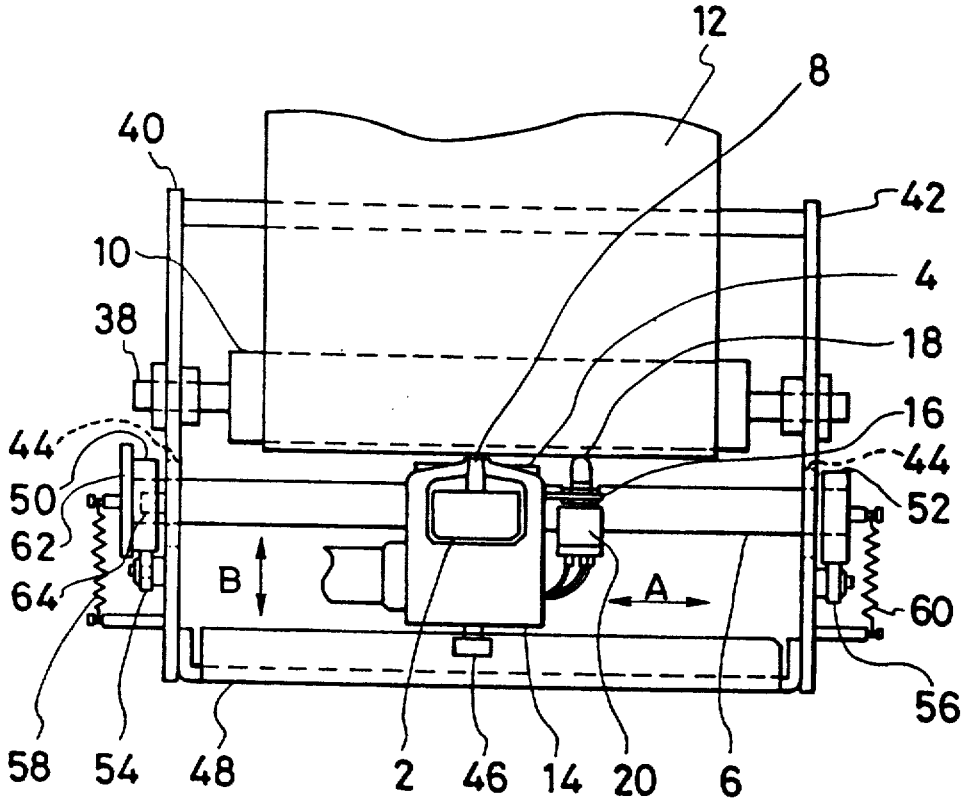
FIG. 5 is a plan view of a printer with a cylindrical platen employing the novel head gap adjustment device.

FIG. 5 is a plan view of this printer. The print head 2, carriage 4, guide shaft 6, ribbon cartridge 14, arm 16, plunger 18, and linear transducer 20 are as described in FIG. 1. The platen 10 is cylindrical in shape, and is mounted on a platen shaft 38 which is rotatably attached to the left side frame 40 and right side frame 42 of the printer.

The guide shaft 6, which extends through a hole in the carriage 4, is slidably and rotatably mounted at its two ends in a pair of horizontally elongated slots 44 in the left and right side frames 40 and 42. At its rear end the carriage 4 is supported by a bearing 46 which rides on a slide beam 48. The slide beam 48 is attached at its left and right ends to the left and right side frames 40 and 42.

The carriage 4 is driven in the direction of the arrow A by a means such as a motor not shown in the drawing. The carriage 4 and guide shaft 6 can move together in the direction of the arrow B.

A pair of cams 50 and 52 are attached to the two ends of the guide shaft 6. The cams 50 and 52 make contact with a pair of cam followers 54 and 56 attached to the left and right side frames 40 and 42, contact being maintained by a pair of springs 58 and 60 extending from the ends of the guide shaft 6 to pins mounted on the left and right side frames 40 and 42. A driven gear 62 is attached to the guide shaft 6 at its left end. A limit post 64 is attached to the left side frame 40.

Figure 6:
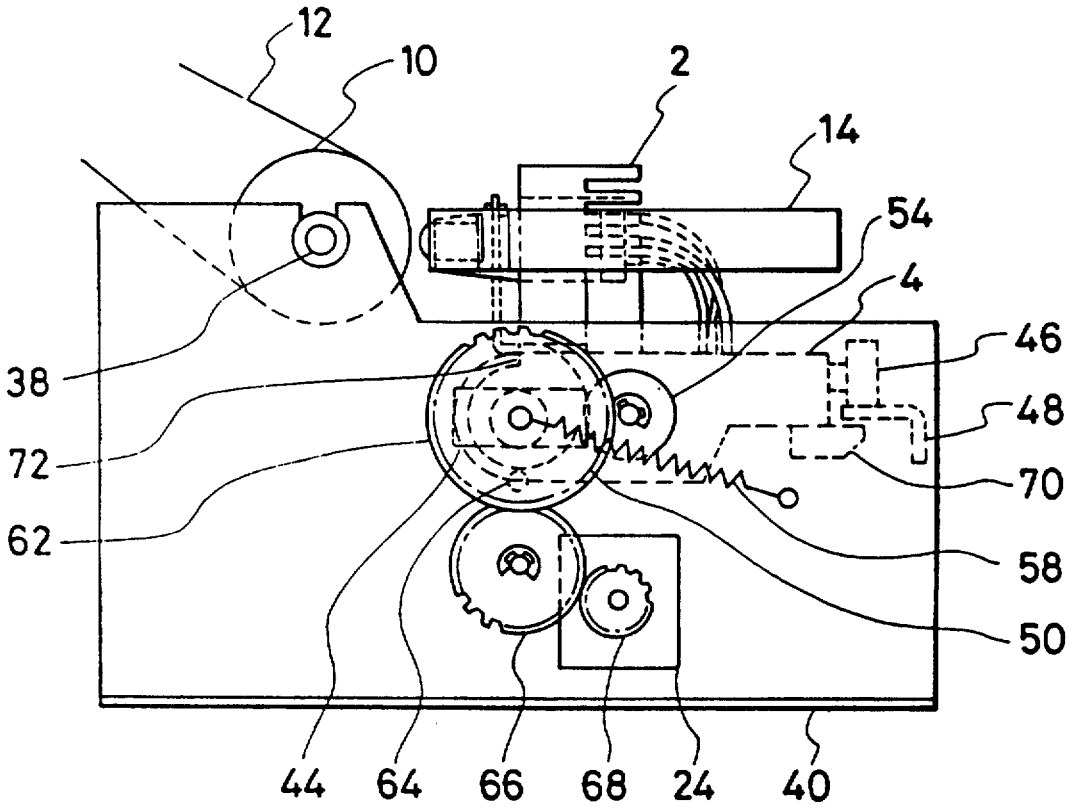
FIG. 6 is a side view of the printer in FIG. 5.

FIG. 6 is a left side view of the printer in FIG. 5, showing the driven gear 62 and its associated driving mechanism. The driven gear 62 engages an idle gear 66 which is rotatably mounted directly below the driven gear 62 on the left side frame 40. The idle gear 66 engages a driving gear 68 which is driven by a stepping motor 24, this being the stepping motor 24 illustrated in FIG. 2. Motion of the driving gear 68 is transmitted through the idle gear 66 to the driven gear 62, causing the entire assembly comprising the driven gear 62, cam 50, and guide shaft 6 to rotate clockwise or counterclockwise. The limit post 64 attached to the left side frame 40 limits the amount of rotation.

At the rear, the bearing 46 is free to slide forward and backward (right and left in FIG. 6) on the slide beam 48. A guide 70 keeps the bearing 46 from jumping off the slide beam 48.

The control system of the head gap adjustment device is as illustrated in FIG. 2. The mechanical operation of the head gap adjustment device will be explained next.

When the controller 30 sends reverse commands in the standby sequence as previously described, the stepping motor 24 drives the driving gear 68 counterclockwise, the idle gear 66 clockwise, and the driven gear 62 counterclockwise in FIG. 6. As the driven gear 62 turns counterclockwise, the spring 58 pulls the guide shaft 6 and the carriage 4 to the right in FIG. 6, widening the gap between the print head 2 and the platen 10. The number of reverse drive pulses sent to the stepping motor 24 is a fixed number which is sufficient to turn the cam 50 fully counterclockwise, regardless of its previous position. The stepping motor 24 accordingly drives the driving gear 68 until the vertical cheek 72 of the cam 50 rests against the limit post 64, widening the head gap to its maximum extent.

When a print medium 12 is loaded and print data are supplied, the controller 30 begins the gap adjustment sequence. That is, it begins sending forward commands that cause to the stepping motor 24 to drive the driving gear 68 clockwise, the idle gear 66 counterclockwise, and driven gear 62 clockwise in FIG. 6. By pushing against the cam follower 54, the cam 50 moves the carriage 4 to the left in FIG. 6, narrowing the head gap.

The tip of the plunger 18 will then be brought into contact with the print medium 12 and the plunger 18 then begins to be depressed, and the output signal V from the linear transducer 20 begins to change. When the controller 30 determines that the output signal V has changed by the amount $V_0$, it sends a fixed sequence of t reverse commands as described earlier, causing the stepping motor 24 to drive the driving gear 68 counterclockwise, moving the carriage 4 a fixed distance to the right in FIG. 6, thereby adjusting the gap to the desired value.

A printer employing the novel head gap adjustment device as described above has been tested with the following parameter values:

$G_1$=0.31 mm (desired head gap)
$G_2$=0.2 mm (projection of plunger beyond print head)
$V_0$=20 mV (required voltage change)
$S_0$=0.1 mm (required stroke of plunger)

The force required to depress the plunger 18 was 300 g, and the amount of play at forward-reverse switchover of the gap adjustment mechanism was 0.01 mm. In tests with single-ply bond paper, the variation in the head gap with the novel head gap adjustment device was about 0.07 mm less than with a prior-art device which drove the carriage 4 forward and backward for fixed numbers of pulses.

In the embodiment described above, when the controller 30 determines that the output signal V has changed by the amount $V_0$, it sends a fixed sequence of t reverse commands to adjust the head gap to the desired value. As an alternative, the controller may sends a fixed sequence of (t+u) reverse commands, causing the stepping motor 24 to drive the driving gear 68 counterclockwise, moving the carriage 4 a fixed distance to the right in FIG. 6, and then sends a final sequence of u forward commands, thereby adjusting the gap to the desired value.

In the embodiment described above, the cams 50 and 52, and cam followers 54 and 56 are used as a mechanism for converting the rotation of the motor 24 to the back and forth movement of the print head 2. Alternatively, racks and pinions may be used as such a converting mechanism.

In the embodiment described above, the print head 2 is moved with respect to the platen 10 to adjust the head gap. The platen 16 may be moved instead.

Next another detailed description of the invention will be given, illustrating an application to a printer with a horizontal, flat platen. In this application the stepping motor 24 moves the platen by means of a rack-and-pinion mechanism.

Figure 7:
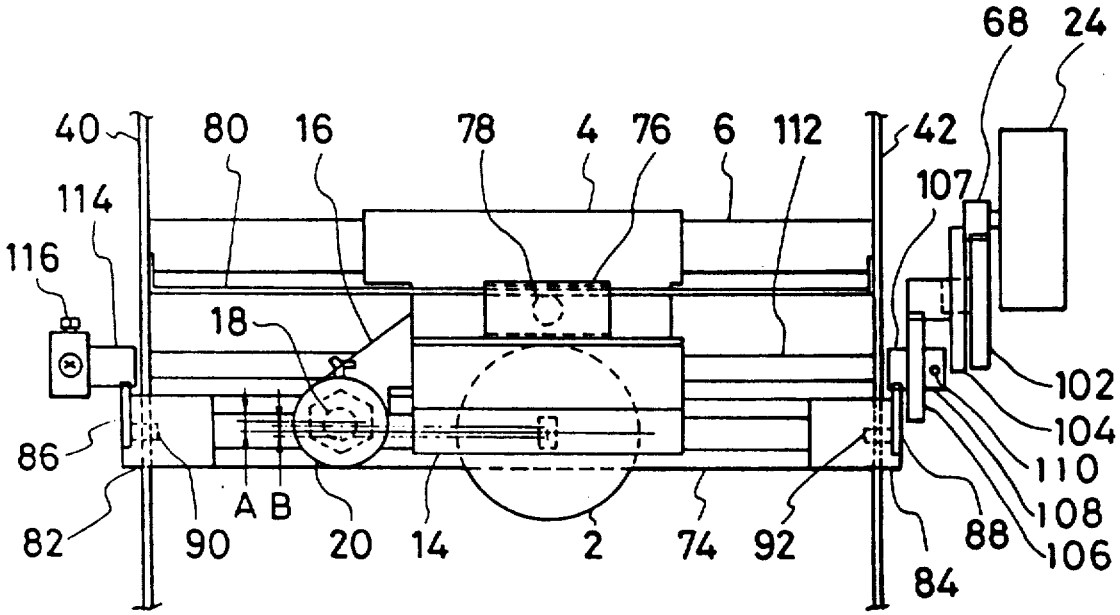
FIG. 7 is a plan view of a printer with a flat platen employing the novel head gap adjustment device.

FIG. 7 is a plan view of the printer, looking down on its flat platen 74 which horizontally supports a print medium not shown in the drawing. The print head 2, carriage 4, ribbon cartridge 14, arm 16, and linear transducer 20 are as described in FIG. 1, and are mounted vertically above the flat platen 74. The direction of printing action in FIG. 7 is down onto the print medium. The linear transducer 20 is structured as described in FIG. 1, having a plunger 18 that projects below the front end 8 of the print head 2.

Figure 8:
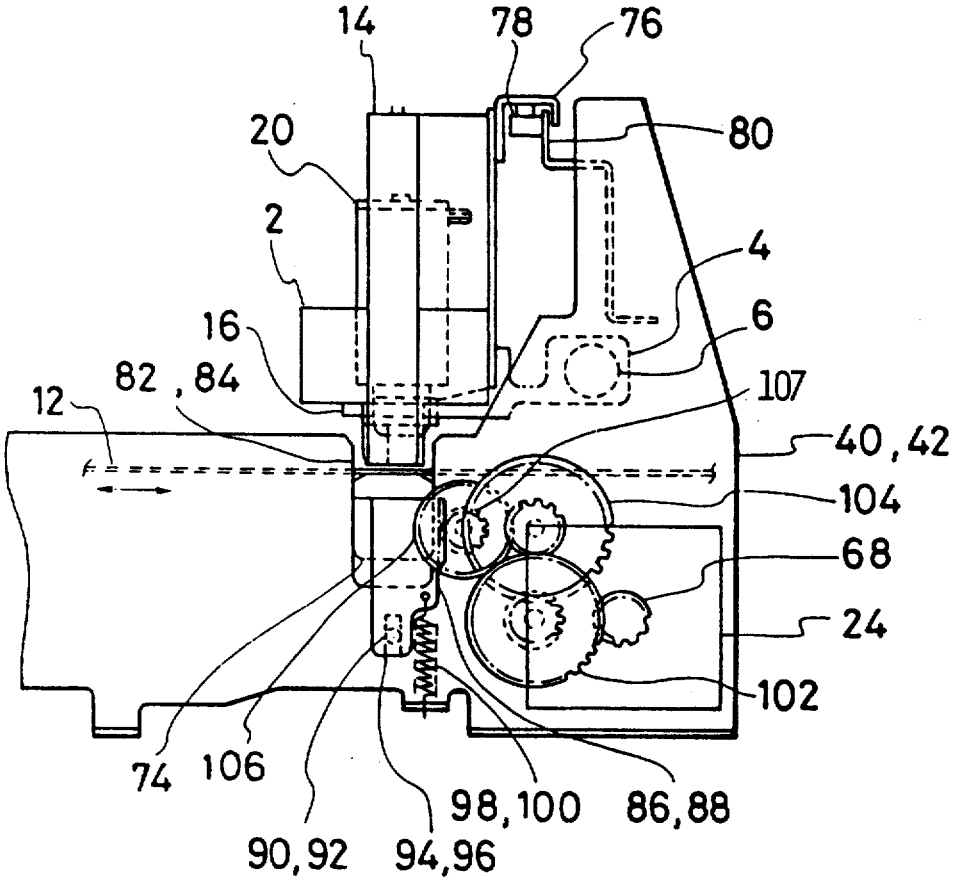
FIG. 8 is a side view of the printer in FIG. 7.

FIG. 8 is a left side view of this printer. Pairs of reference numerals indicate corresponding elements on the left and right sides of the printer. With reference to FIG. 7 and FIG. 8, the carriage 4 is slidably supported by a guide shaft 6 which passes through a hole in the carriage 4, and is also supported at the top by a guide 76 and a bearing 78 which are engaged with a slide beam 80. The left and right ends of the slide beam 80 are attached to the left and right side frames 40 and 42 of the printer. The carriage 4 can be moved horizontally along the guide shaft 6 and the slide beam 80, in the left-right direction in FIG. 7, by a device such as a motor not shown in the drawings.

The two ends of the flat platen 74 are slidably disposed in slots 82 and 84 in the left side and right side frames 40 and 42, and supported by the vertically extending edges of the slots 82 and 84 such that the platen 74 is vertically slidable. A pair of toothed racks 86 and 88 are attached to the ends of the flat platen 74. The racks 86 and 88 have posts 90 and 92 which fit slidably into vertically elongated slots 94 and 96 in the left and right side frames 40 and 42. The function of the posts 90 and 92 and slots 94 and 96 is to guide and limit the motion of the racks 86 and 88. Springs 98 and 100 attached to the racks 86 and 88 and the left and right side frames 40 and 42 exert a downward tension on the racks 86 and 88, pulling them away from the print head 2. The springs 98 and 100 may however may omitted.

With reference to FIG. 7, the stepping motor 24 described in FIG. 2 is attached to the right side frame 42 by a bracket not shown in the drawings. A driving gear 68 is attached to the shaft of the stepping motor 24.

Reduction gears 102 and 104 are rotatably attached to the above-mentioned bracket, forming a reducing gear train that transmits the rotation of the driving gear 68 to a gear 106. The boss 108 of the pinion 106 is attached by a pin 110 to a shaft 112. The small gear of the reduction gear 104 engages the gear 106. A pinion 107 integral with the gear 106 engages the rack 88. Another pinion 114 is attached by setscrews 116 to the other end of the shaft 112, and engages the rack 86.

The shaft 112 is rotatably mounted in the left and right side frames 40 and 42. When the shaft 112 turns, the pinions 107 and 114 drive the racks 86 and 88, thereby moving the flat platen 74 vertically in the slots 82 and 84. The pinion 107 has the same number of teeth as the pinion 114, so the flat platen 74 is driven up or down horizontally. Paper 12 can be transported over the platen 74, in the direction of the arrow in FIG. 8, by means of a feed roller not shown in the drawing.

The head gap adjustment device has the control circuitry illustrated in FIG. 2, and operates in a similar manner. When the printer's power is switched on, or when printing on a print medium is completed and the print medium is discharged, the standby sequence is started in which the stepping motor 24 is driven in reverse, turning the reduction gear 102 counterclockwise, the reduction gear 104 clockwise, and the pinion 107 counterclockwise in FIG. 8, thereby driving the racks 86 and 88 downward until the attached posts 90 and 92 make contact with the bottoms of the slots 94 and 96. The flat platen 74 thus moves down and the head gap opens to its maximum extent. When a print medium 12 is loaded and print data received, the gap adjustment sequence is started, in which the stepping motor 24 is driven forward, moving the flat platen 74 upward. The flat platen 74 lifts the print medium 12 into contact with the plunger 18, the begins pushing the plunger 18 upward, as shown in FIG. 1. The output V of the linear transducer 20 increases by an amount proportional to the stroke S of the plunger 18. When the change in V reaches a certain value $V_0$, the stepping motor 24 is reversed for a fixed number (t+u) of pulses, thereby moving the flat platen 74 down, then driven forward for a smaller fixed number (u) of pulses to adjust the head gap to the optimum value, which is normally in the vicinity of 0.3 mm to 0.5 mm.

With reference to FIG. 7, the linear transducer 20 is offset by a distance A from the center line through the print head 2. The parameter A is preferably greater than one half the maximum height B of the printed characters, i.e., the length of the row of the tips of the print wires, so that the plunger 18 is disposed over an unprinted area. Then even if the print medium does not lie perfectly flat on the flat platen 74 but rises to touch the plunger 18 during printing, no smudging will occur.

In the embodiment described above, when the controller 30 determines that the output signal V has changed by the amount $V_0$, it sends a fixed sequence of (t+u) reverse commands, and then sends a final sequence of u forward commands, thereby adjusting the gap to the desired value. As an alternative, the controller may send a fixed sequence of t reverse commands, without the extra u reverse commands and the subsequent u forward commands to cancel the effect of the play in the transmission mechanism. This will simplify the control.

In the embodiment described above, the racks 86 and 88, and pinion 107 and 114 are used as a mechanism for converting the rotation of the motor 24 to the back and forth movement of the platen 74. Alternatively, cams and cam followers may be used as such a converting mechanism.

In the embodiment described above, the platen 74 is moved with respect to the print head 2 to adjust the head gap. The print head 2 may be moved instead.

Figure 9:
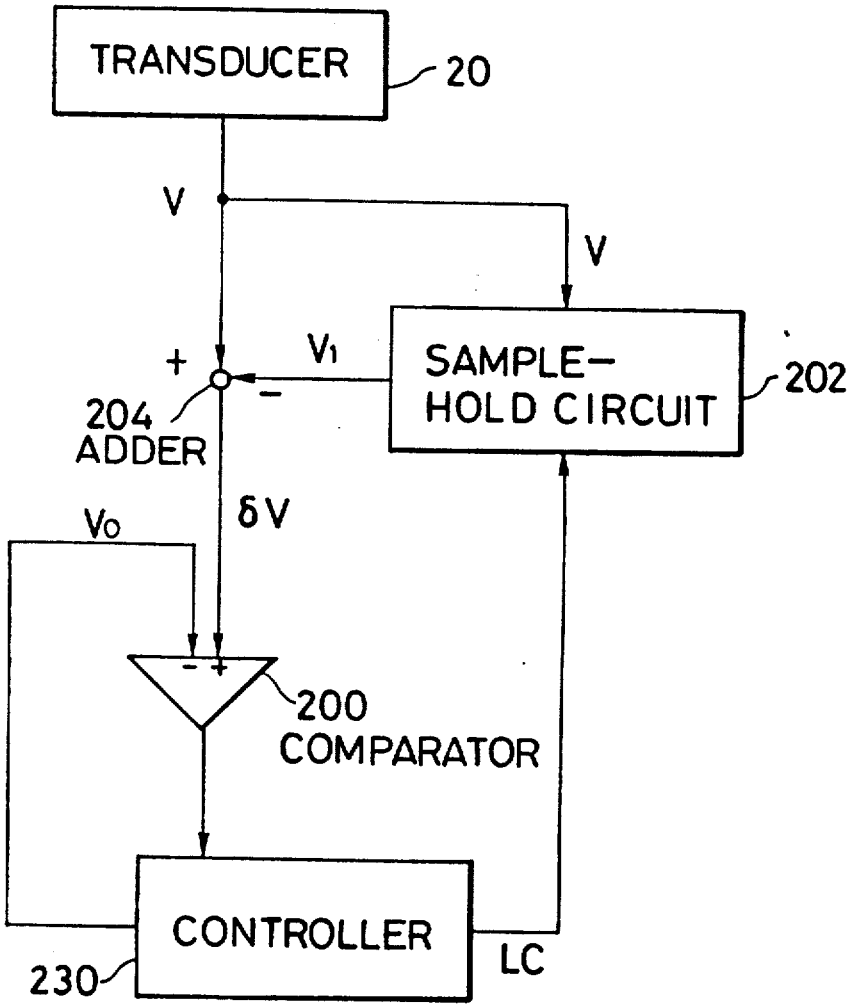
FIG. 9 is a block diagram showing a modification of the control system.

In the embodiments described, the controller 30 receives the output signal V from the transducer 20 through the A/D converter 28, and the value of $V_2=V_1+V_0$, with $V_1$ being the value of V at the maximum head gap, is stored in a register within the controller 30, and the digital value of V is compared with the stored digital value of $V_2$ by the function of the controller 30. A modification is shown in FIG. 9. In this modification, a controller 230 operates in a manner similar to the controller 30 described above, except as described below. That is, during the standby sequence, the controller 230 sends reverse commands to the drive circuit 32, to widen the head gap. When the head gap is maximum, and when a print medium is loaded for printing and print data are received from a host device, the controller 230 starts the gap adjustment sequence in which it produces a latch control signal LC, responsive to which a sample-hold circuit 202 latches the output signal V, and the controller 230 begins sending forward commands to the drive circuit 32 to narrow the head gap. The value latched in the sample-hold circuit 202 is $V_1$, which the sample-hold circuit 202 keeps outputting. An adder 204 subtracts $V_1$ from V and outputs the difference $\delta V=V-V_1$. A comparator 200 compares $\delta V$ with a predetermined value $V_0$ supplied from the controller 230, and its output becomes High when the former reaches the latter. The output of the comparator 200 is applied to the controller 230. When the output of the comparator 200 becomes High, the controller 230 finds the stroke S to have reached the predetermined value $S_0$, and stops sending the forward commands to the drive circuit 32, and begins sending reverse commands.

The scope of this invention is not limited to the structures shown in the drawings, but includes many variations and modifications that will be apparent to one skilled in the art.

What is claimed is:

1. A head gap adjustment device for adjusting the gap between a print head of a printer and a print medium disposed on a platen of said printer, comprising:
   - a motor in operative relationship with at least one of said print head and said platen, drivable in forward and reverse directions, for narrowing said gap when driven forward and widening when driven in reverse;
   - a transducer fixedly attached to said print head;
   - a plunger moveable back and forth relative to said transducer, and having a tip projecting beyond said print head toward said platen;
   - said transducer producing an output signal representative of the position of said plunger relative to said transducer; and
   - a controller, connected to said motor and said transducer, for driving said motor forward until said output signal changes by a certain amount, then driving said motor by a fixed amount in reverse.

2. The head gap adjustment device of claim 1, wherein said motor narrows and widens said gap by moving said print head.

3. The head gap adjustment device of claim 1, wherein said motor narrows and widens said gap by moving said platen.

4. The head gap adjustment device of claim 1, wherein after driving said motor by a said fixed amount in reverse, said controller drives said motor by an extra fixed amount in reverse, then drives said motor forward by said extra fixed amount.

5. The head gap adjustment device of claim 1, wherein said motor is a stepping motor.

6. The head gap adjustment device of claim 1, wherein said plunger reaches the position at which said output signal changes by said certain amount while said tip of said plunger still projects beyond said print head, 7. The head gap adjustment device of claim 1, wherein said fixed amount by which said motor is driven in reverse is sufficient to retract said plunger from said print medium.

8. The head gap adjustment device of claim 1, wherein said tip of said plunger is rounded.

9. A head gap adjustment device for adjusting the gap between a print heat of a printer and a print medium disposed on a platen of said printer, comprising:
   - a guide shaft, rotatably and slidably mounted in said printer, for supporting and guiding said print head;
   - a pair of cams attached to respective ends of said guide shaft;
   - a pair of cam followers attached to said printer;

a pair of springs, attached to respective ends of said guide shaft and to said printer, for maintaining contact between said cams and said cam followers;

a driven gear attached to one end of said guide shaft;

a driving gear for turning said driven gear;

a motor, drivable in forward and reverse directions, for turning said driving gear;

a transducer fixedly attached to said print head;

a plunger moveable back and forth relative to said transducer, and having a tip projecting beyond said print head toward said platen;

said transducer producing an output signal representative of the position of said plunger relative to said transducer; and a controller, connected to said motor and said transducer, for driving said motor forward until said output signal changes by a certain amount, then driving said motor by a fixed amount in reverse.

10. The head gap adjustment device of claim 9, further comprising an idle gear disposed between said driven gear and said driving gear, for transmitting the rotation of said driving gear to said driven gear.

11. The head gap adjustment device of claim 9, further comprising a limit post for limiting the rotation of said cam when the head gap is widened to its extremity.

12. The head gap adjustment device of claim 9, wherein after driving said motor by a said fixed amount in reverse, said controller drives said motor by an extra fixed amount in reverse, then drives said motor forward by said extra fixed amount.

13. The head gap adjustment device of claim 9, wherein said motor is a stepping motor.

14. The head gap adjustment device of claim 9, wherein said plunger reaches the position at which said output signal changes by said certain amount while said tip of said plunger still projects beyond said print head.

15. The head gap adjustment device of claim 9, wherein said fixed amount by which said motor is driven in reverse is sufficient to retract said plunger from said print medium.

16. The head gap adjustment device of claim 9, wherein said tip of said plunger is rounded.

17. A head gap adjustment device for adjusting the gap between a print head of a printer and a print medium disposed on a platen of said printer, comprising:

a pair of toothed racks attached to respective ends of said platen and slidably mounted in said printer;

a shaft rotatably mounted in said printer parallel to said platen;

a pair of pinions, attached to said shaft, for engaging said racks;

a driving gear for turning one of said pinions;

a motor, drivable in forward and reverse directions, for turning said driving gear;

a transducer fixedly attached to said print head;

a plunger moveable back and forth relative to said transducer, and having a tip projecting beyond said print head toward said platen;

said transducer producing an output signal representative of the position of said plunger relative to said transducer; and a controller, connected to said motor and said transducer, for driving said motor forward until said output signal changes by a certain amount, then driving said motor by a fixed amount in reverse.

18. The head gap adjustment device of claim 17, further comprising a reducing gear train disposed between said driving gear and said one of said pinions, for transmitting the rotation of said driving gear to said one of said pinions.

19. The head gap adjustment device of claim 17, wherein said platen is flat.

20. The head gap adjustment device of claim 19, wherein said platen is disposed below said print head, and said racks are slidable in the vertical direction.

21. The head gap adjustment device of claim 19, wherein said plunger is offset by a certain distance from the center line through said print head.

22. The head gap adjustment device of claim 21, wherein said certain distance is greater than one half the length of a row of print wires in said print head.

23. The head gap adjustment device of claim 17, wherein said racks have posts slidably disposed in slots in said printer for guiding and limiting the motion of said racks when the head gap is widened to its extremity.

24. The head gap adjustment device of claim 17, wherein after driving said motor by a said fixed amount in reverse, said controller drives said motor by an extra fixed amount in reverse, then drives said motor forward by said extra fixed amount.

25. The head gap adjustment device of claim 17, wherein said motor is a stepping motor.

26. The head gap adjustment device of claim 17, where said plunger reaches the position at which said output signal changes by said certain amount while said tip of said plunger still projects beyond said print head.

27. The head gap adjustment device of claim 17, wherein said fixed amount by which said motor is driven in reverse is sufficient to retract said plunger from said print medium.

28. The head gap adjustment device of claim 17, wherein said tip of said plunger is rounded.

* * * * *